US007914098B2

(12) United States Patent
Albrecht et al.

(10) Patent No.: US 7,914,098 B2
(45) Date of Patent: Mar. 29, 2011

(54) DEVICE FOR PATTERNING WORKPIECES

(75) Inventors: Ludwig Albrecht, Dornstetten-Aach (DE); Karl Frey, Schopfloch (DE); Achim Gauss, Dornstetten/Hallwangen (DE)

(73) Assignee: Homag Holzbearbeitungssysteme AG, Schopfloch (DE)

( * ) Notice: Subject to any disclaimer, the term of this patent is extended or adjusted under 35 U.S.C. 154(b) by 393 days.

(21) Appl. No.: 11/935,924

(22) Filed: Nov. 6, 2007

(65) Prior Publication Data

US 2008/0106568 A1 May 8, 2008

(30) Foreign Application Priority Data

Nov. 7, 2006 (EP) ..... 06023120

(51) Int. Cl.
*B41J 2/205* (2006.01)

(52) U.S. Cl. ..... 347/15; 347/19

(58) Field of Classification Search ..... 347/12, 347/15, 40, 43, 4, 19, 81; 358/1.2, 1.9
See application file for complete search history.

(56) References Cited

U.S. PATENT DOCUMENTS

| | | | | |
|---|---|---|---|---|
| 3,975,740 | A | | 8/1976 | Distler |
| 4,017,869 | A | | 4/1977 | Meyer |
| 4,720,301 | A | | 1/1988 | Kito et al. |
| 4,814,795 | A | | 3/1989 | Kuester et al. |
| 5,581,284 | A | * | 12/1996 | Hermanson ..... 347/43 |
| 5,810,487 | A | | 9/1998 | Kano et al. |
| 5,869,138 | A | | 2/1999 | Nishibori |
| 5,931,098 | A | | 8/1999 | Bates |
| 6,053,231 | A | | 4/2000 | Matsuguchi |
| 6,286,920 | B1 | | 9/2001 | Ridgway |
| 6,358,220 | B1 | | 3/2002 | Gunter et al. |
| 6,465,046 | B1 | | 10/2002 | Hansson |
| 6,635,142 | B1 | | 10/2003 | Stula et al. |
| 6,694,872 | B1 | | 2/2004 | LaBelle et al. |
| 6,789,876 | B2 | | 9/2004 | Barclay et al. |
| 6,894,709 | B2 | | 1/2005 | Pferrer |
| 7,357,959 | B2 | | 4/2008 | Bauer |
| 7,691,294 | B2 | | 4/2010 | Chung et al. |
| 2001/0003871 | A1 | | 6/2001 | Patton et al. |
| 2001/0005942 | A1 | | 7/2001 | Patton et al. |
| 2001/0049010 | A1 | | 12/2001 | Fenzi |
| 2002/0024577 | A1 | | 2/2002 | Takeya et al. |
| 2002/0033851 | A1 | | 3/2002 | Waldner et al. |

(Continued)

FOREIGN PATENT DOCUMENTS

CA 2492712 12/2004

(Continued)

OTHER PUBLICATIONS

European Search Report issued in EP06023120.6 on Apr. 25, 2008.

(Continued)

*Primary Examiner* — Lamson D Nguyen
(74) *Attorney, Agent, or Firm* — Baker Botts L.L.P.

(57) ABSTRACT

The invention relates to a device (1) for patterning workpieces (2), which preferably consist at least partially of wood, wood materials or the like, having an ink-jet printing means (10) having a plurality of nozzles (12) from which drops of ink can be expelled, a workpiece carrier means (20) for carrying the workpiece (2) to be patterned, a conveyor device for bringing about a relative movement between the workpiece (2) to be patterned and the printing means (10). The device according to the invention is characterised in that it further has at least one image detection sensor (46).

15 Claims, 5 Drawing Sheets

U.S. PATENT DOCUMENTS

| | | | |
|---|---|---|---|
| 2002/0033865 | A1 | 3/2002 | Ishinaga et al. |
| 2002/0061389 | A1 | 5/2002 | Brooker et al. |
| 2003/0020767 | A1 | 1/2003 | Saksa |
| 2003/0043246 | A1 | 3/2003 | Codos |
| 2003/0048343 | A1 | 3/2003 | Anderson |
| 2003/0218650 | A1 | 11/2003 | Valero |
| 2003/0218663 | A1 | 11/2003 | Baxter et al. |
| 2004/0028830 | A1 | 2/2004 | Bauer |
| 2004/0094426 | A1 | 5/2004 | Lai |
| 2004/0250947 | A1 | 12/2004 | Phillips et al. |
| 2004/0257398 | A1 | 12/2004 | Otsuki |
| 2004/0263544 | A1 | 12/2004 | Kojima |
| 2005/0017995 | A1 | 1/2005 | Pferrer |
| 2005/0204593 | A1 | 9/2005 | Bilger et al. |
| 2005/0274272 | A1 | 12/2005 | Machesky |
| 2006/0021535 | A1 | 2/2006 | Kaiser |
| 2006/0023018 | A1 | 2/2006 | Hatayama |
| 2006/0046326 | A1 | 3/2006 | Kok et al. |
| 2006/0228150 | A1 | 10/2006 | Hosokawa |
| 2007/0091132 | A1 | 4/2007 | Lim |
| 2007/0263043 | A1 | 11/2007 | Bradford et al. |
| 2008/0092923 | A1 | 4/2008 | Elbing et al. |
| 2008/0277630 | A1 | 11/2008 | Kiyoshima et al. |

FOREIGN PATENT DOCUMENTS

| | | | |
|---|---|---|---|
| CN | 1681656 | | 10/2005 |
| DE | 19532724 | | 3/1997 |
| DE | 19823195 | | 11/1999 |
| DE | 202004000662 | U1 | 4/2004 |
| DE | 202006000270 | U | 4/2006 |
| DE | 10 2005 020119 | B3 | 6/2006 |
| DE | 102005020119 | | 6/2006 |
| EP | 0095046 | | 11/1983 |
| EP | 0494363 | | 7/1992 |
| EP | 0993903 | | 4/2000 |
| EP | 1 190 864 | | 3/2002 |
| EP | 1225053 | | 7/2002 |
| EP | 1435296 | | 7/2004 |
| EP | 1479524 | | 11/2004 |
| EP | 1714884 | | 10/2006 |
| EP | 1726443 | | 11/2006 |
| FR | 2601265 | | 1/1988 |
| GB | 722485 | | 1/1955 |
| GB | 2335885 | | 10/1999 |
| GB | 2 384 931 | | 8/2003 |
| JP | 02006164 | | 1/1990 |
| JP | 10157245 | | 6/1998 |
| JP | 10226045 | | 8/1998 |
| WO | WO0148333 | | 7/2001 |
| WO | WO2004016438 | | 2/2004 |
| WO | WO2005009735 | | 2/2005 |

OTHER PUBLICATIONS

U.S. Appl. No. 11/632,461, filed Oct. 22, 2007.
U.S. Appl. No. 11/765,196, filed Jun. 19, 2007.
U.S. Appl. No. 11/844,607, filed Aug. 24, 2007.
U.S. Appl. No. 11/940,135, filed Nov. 14, 2007.
U.S. Appl. No. 12/055,904, filed Mar. 26, 2008.
U.S. Appl. No. 12/118,389, filed May 9, 2008.
U.S. Appl. No. 11/632,461, Jun. 9, 2010 Restriction Requirement.
U.S. Appl. No. 11/765,196, Apr. 1, 2010 Non-Final Office Action.
U.S. Appl. No. 11/765,196, Jul. 2, 2010 Response to Non-Final Office Action.
U.S. Appl. No. 11/940,135, Apr. 5, 2010 Non-Final Office Action.
U.S. Appl. No. 12/055,904, Apr. 2, 2010 Non-Final Office Action.
U.S. Appl. No. 12/055,904, Jul. 2, 2010 Response to Non-Final Office Action.
U.S. Appl. No. 11/844,607, Dec. 2, 2010—Response to Non-Final Office Action.
U.S. Appl. No. 11/765,196, Dec. 16, 2010—Response to Final Office Action.
U.S. Appl. No. 12/055,904, Dec. 16, 2010—Final Office Action.
U.S. Appl. No. 11/632,461, Dec. 21, 2010—Non-Final Office Action.
U.S. Appl. No. 11/940,135, Jan. 4, 2011—Response to Final Office Action.
U.S. Appl. No. 11/765,196, Jan. 18, 2011—Non-Final Office Action.
U.S. Appl. No. 11/940,135, Jan. 19, 2011—Advisory Action.
U.S. Appl. No. 11/844,607, Feb. 4, 2011—Final Office Action.
U.S. Appl. No. 11/940,135, Aug. 5, 2010 Response to Non-Final Office Action.
U.S. Appl. No. 11/844,607, Sep. 2, 2010 Non-Final Office Action.
U.S. Appl. No. 11/765,196, Sep. 22, 2010 Final Office Action.
U.S. Appl. No. 12/055,904, Sep. 30, 2010 Supplemental Response to Non-Final Office Action.
U.S. Appl. No. 11/940,135, Oct. 4, 2010 Final Office Action.

* cited by examiner

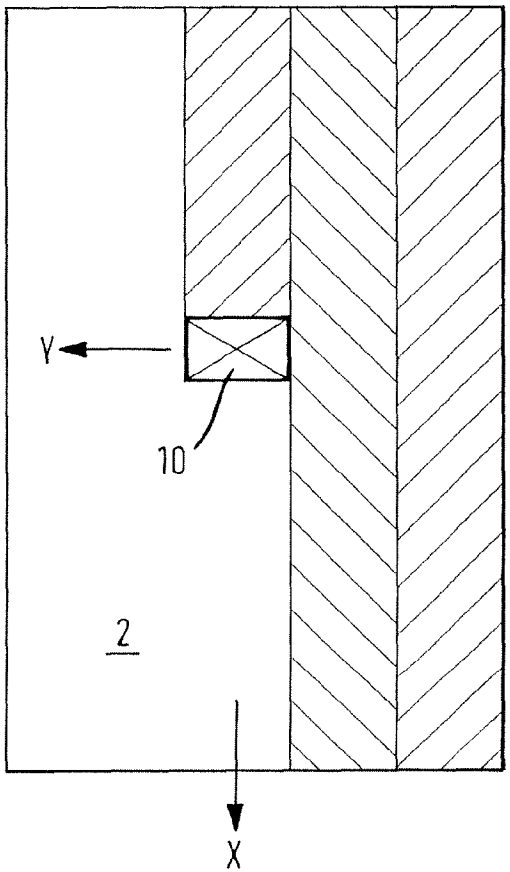
Fig. 6
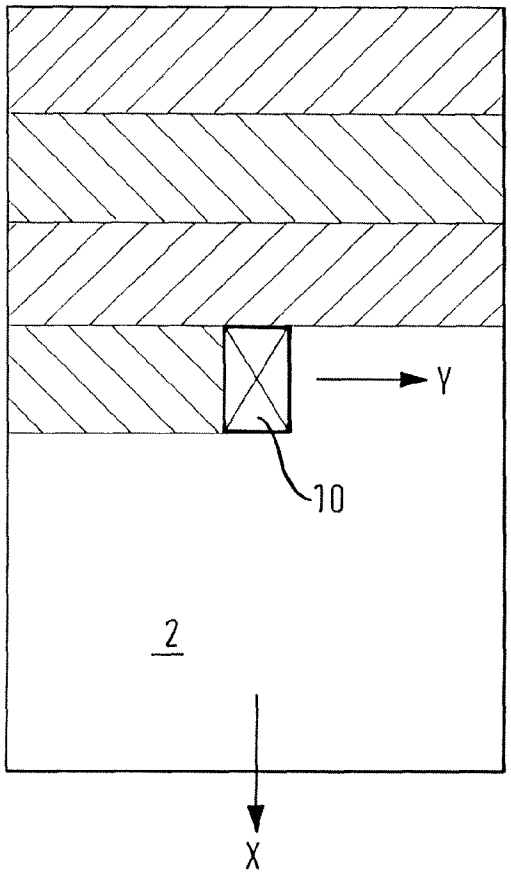

DEVICE FOR PATTERNING WORKPIECES

TECHNICAL FIELD

The invention relates to a device for patterning workpieces, which preferably consist at least partially of wood, wood materials or the like, according to the preamble of claim 1.

PRIOR ART

A device of the type mentioned at the outset is known, for example, from DE 100 31 030 B4 and has sensors for roughly detecting the contour and thickness of the workpieces to be imprinted which are attached to a conveyor device or to a portal. Nevertheless, it has been found that the workpieces imprinted using a device of this type often have a distorted, smudged printed image or else a printed image displaying defects and colour variations.

Furthermore, European patent application EP 05 009 326.9, which was filed by the Applicant and has not yet been published, also relates to a device according to the preamble of claim 1.

PRESENTATION OF THE INVENTION

The object of the present invention is therefore to provide a generic device for patterning workpieces that allows an improved printed image quality.

According to the invention, this object is achieved by a device according to claim 1 and a method according to claim 7. Particularly advantageous developments of the invention are specified in the dependent claims.

The underlying idea of the invention is that of basing the printing process, by targeted preprocessing and/or postprocessing, on completely new information. For this purpose, provision is made for the device according to the invention also to have at least one image detection sensor. The provision of at least one image detection sensor opens up entirely new possibilities for controlling and optimising the printing process. It is thus possible, for example, to determine using the image detection sensor the precise position of the workpiece relative to the printing means even before the printing process ("preprocessing"). This allows distortion and smudging of the printed image, which are caused by inadequate relative positioning, to be avoided or minimised. An "overspray", i.e. printing being carried out beyond a free edge of the workpiece and ink mist being deposited on an adjacent surface of the workpiece, can also be effectively prevented.

However, even after a printing process (or before a subsequent printing process), the image detection sensor provided in accordance with the invention can be effectively used to analyse the workpiece surface. For example, the image sensor can be used to carry out an analysis of the workpiece surface with regard to possible defects, colour variations or the like in order to check and, for example, to maintain, to clean, to adjust, etc. the printing means on this basis.

These and further possible applications of the image detection sensor allow the quality of the printed image to be greatly increased over the prior art. The term "image detection sensor" refers in this case at least to any means which operates on an optical basis and supplies information about the image formed (which may or may not be visible to the human eye), so use may be made of a broad range of means including, for example, spectrophotometers with or without (RGB) filters.

In order to be able efficiently to implement the above-described and further possible applications of the image detection sensor to improve the quality of the printed image, a development of the invention provides for the device further to have a control means which is connected to the at least one image detection sensor and the ink-jet printing means.

Within the scope of the present invention, the image detection sensor can have a broad range of configurations. However, with regard to rapid and precise detection of the respective workpiece surface, a development of the invention provides for at least one image detection sensor to have a camera and/or a colour measuring device. A CCD camera has proven especially advantageous in this regard, as the digital data obtained can be forwarded particularly simply and rapidly to a control means or the like.

Within the scope of the present invention, the control means can also have a broad range of configurations. Nor is the possibility ruled out that the control means requires in some cases the involvement of an operator. However, with regard to the desired improved quality of the printed image, a development of the invention provides for the control means to be configured to analyse image data obtained by the image detection sensor, preferably at least with regard to the colour spectrum and/or defects and/or geometry and/or colour space (for example, RGB colour space) of each workpiece.

Specifically if the at least one image detection sensor is used to detect the colour spectrum, but also to detect defects, it is important that a reproducible printed image is present at the moment of detection. Against this background, a development of the invention provides for the device further to have a drying means, in particular a UV drying means. This allows a predetermined drying state of the applied ink to be produced before the respective image detection is carried out.

The above-described advantages of the device according to the invention can be achieved particularly advantageously by a method for patterning workpieces according to claim 7. It is in this case particularly preferred that the actual image data obtained through the image detection is compared with desired image data, in particular with regard to the colour spectrum and/or defects and/or geometry and/or colour space (for example, RGB colour space). This desired/actual data comparison can advantageously be utilised as a basis for improving the print quality, for example through the measures described hereinbefore.

A development of the invention provides in this case for the control signals issued by the control means to the printing means to be corrected on the basis of the desired/actual data comparison in order to minimise deviation between the desired/actual data. The control means thus ensures, on the basis of the image detection performed by the image detection sensor, that the printed image which is actually produced approximates the desired printed image as closely as possible, i.e. optimum printed image quality is achieved.

In order to achieve this, the control means can carry out a broad range of measures. However, it has proven particularly effective that the control means corrects, in accordance with a development of the invention, the control signals issued to the printing means in such a way that the intensity and/or the course of the control pulses to at least one nozzle of the printing means are altered. Control pulses can also be dispensed with altogether, i.e. the control signals issued by the control means to the printing means can be corrected in such a way that one or more nozzles are switched on or off.

However, alternatively or additionally, the control means can also ascertain or decide that the determined deviation between the desired/actual data is caused by soiling of the print head, in particular the nozzles. In this case, a development of the method according to the invention provides for cleaning of the printing means to be carried out on the basis of the desired/actual data comparison in the event of a predetermined deviation between the desired/actual data. The control means can also decide, for example if corrective measures are unsuccessful, that basic maintenance of the device or even an emergency stop of the device is required.

It should also be noted that the image detection sensor can operate continuously or discontinuously and that it can operate during normal operation of the device or else during check operation of the device in which, for example, predetermined test patterns are printed and detected by the image detection sensor. Furthermore, the image detection sensor can be positioned at any desired point of the device, wherein it has proven advantageous for at least one image detection sensor to be provided on the printing means.

BRIEF DESCRIPTION OF THE DRAWINGS

FIG. 6 illustrates the operation of the device shown in FIG. 1.

DETAILED DESCRIPTION OF PREFERRED EMBODIMENTS

Preferred embodiments of the present invention will be described hereinafter in detail with reference to the accompanying drawings.

Figure 1:
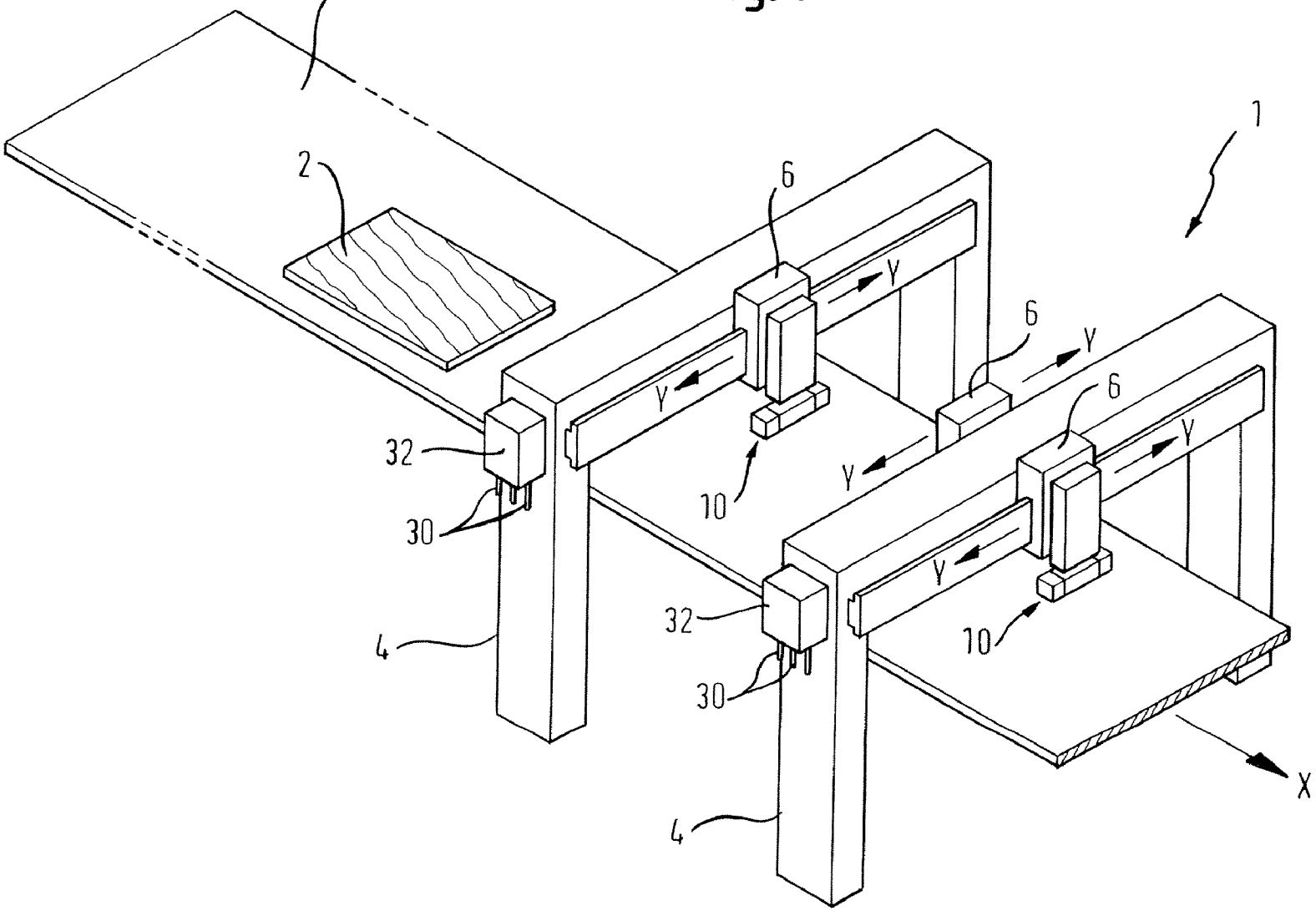
FIG. 1 is a schematic perspective view of a device for patterning workpieces according to an embodiment of the invention.

FIG. 1 is a schematic perspective view of a device 1 for patterning workpieces 2 as a preferred embodiment of the present invention. The device is used for patterning and, if appropriate, machining workpieces 2 which, in the present embodiment, consist at least partially of wood, wood materials, plastics materials or the like, such as are frequently used in the field of furniture and kitchen design.

The device 1 comprises an ink-jet printing means 10 which, in the present embodiment, operates in accordance with the drop-on-demand principle. As may be seen most clearly in FIG. 4, the ink-jet printing means 10 comprises a plurality of nozzles 12 from which drops of ink can be expelled and which, in the present embodiment, are disposed in a plurality of rows, each row being provided for expelling a predetermined colour, for example the colours cyan, magenta, yellow and black.

Figure 3:
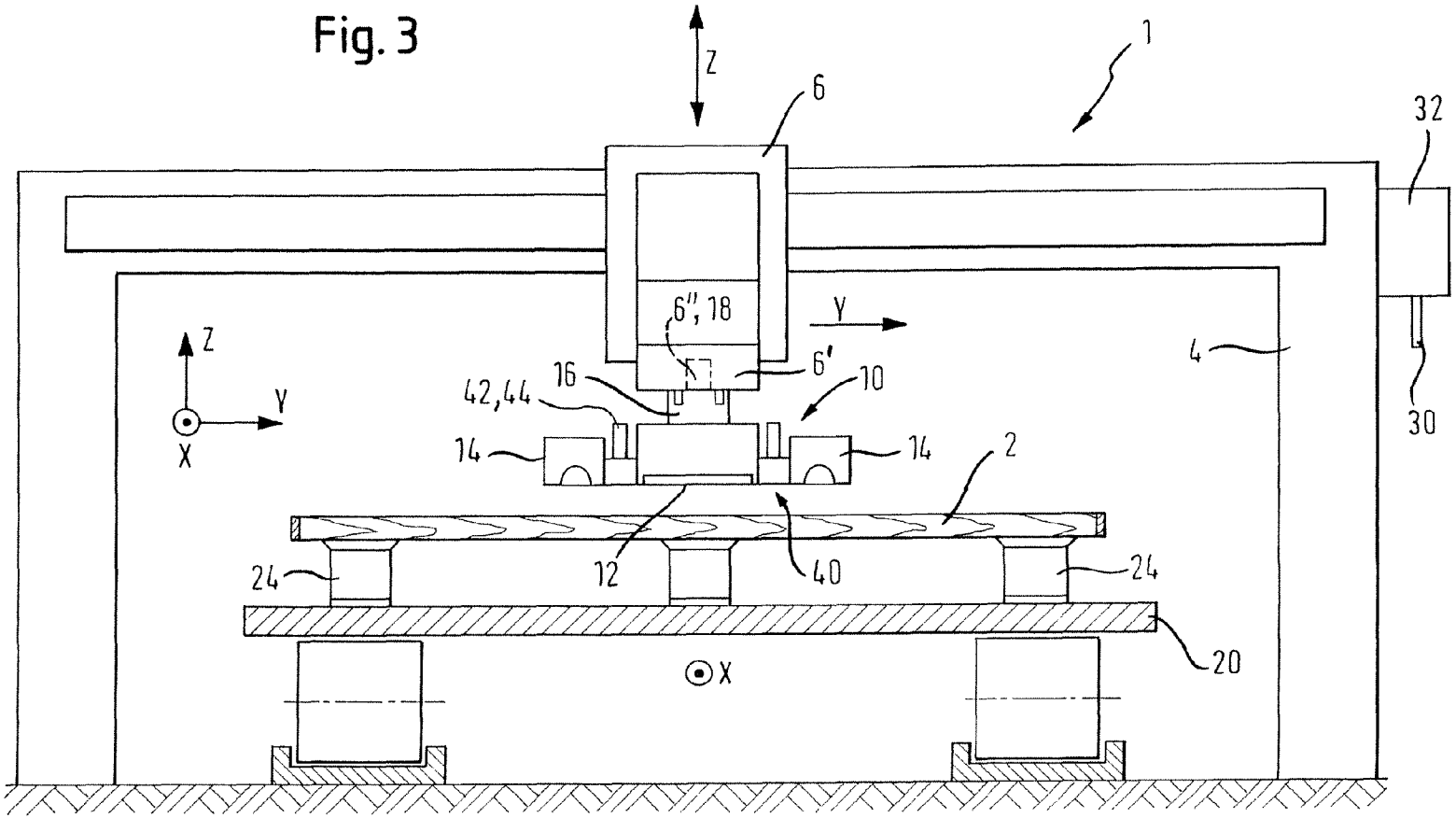
FIG. 3 is a schematic, partially cut-away front view of the device shown in FIG. 1.

The printing means 10 is in the present embodiment provided on or inserted into a spindle unit 6, as may be seen most clearly in FIG. 3. The spindle unit is preferably a spindle unit which is also suitable for the insertable and exchangeable receiving of machining tools or machining installations and which, for this purpose, has a tool receptacle 6' and an interface 6", wherein the interface can, for example, be configured to transfer data, power, drive, fluid, etc.

In order to allow the printing means (printing unit) 10 to be inserted into the spindle unit, the printing unit 10 is provided in the present embodiment with a connecting piece 18 which can be inserted into the tool receptacle 6' of the spindle unit (cf. FIG. 3). Furthermore, the printing unit 10 has transfer means 16 (cf. FIG. 3) which are able to communicate with the interface 6" of the spindle unit. This allows, for example, data, power, drive, fluids, etc. and, in particular, also ink to be transferred. In addition, the printing unit 10 can have an ink reservoir and/or a wireless data transfer means, although this is not shown in the figures.

The spindle unit 6 is provided so as to be movable in the y direction on a portal 4 which can itself, in turn, be configured so as to be movable in the x direction. There are in this case provided in the present embodiment two portals 5, each of which can carry one or more spindle units 6 which can optionally be disposed on opposing sides of the respective portal 4. It should be noted in this regard that the portals 4 can also optionally be configured as jibs.

The spindle units 6 can be automatically or manually fitted, via tool magazines 32 respectively provided at the portals 4, with machining tools and/or machining installations 30 and also one or more printing units 10 (FIG. 3). In other words, the printing units 10 are configured in such a way that they can also be deposited in the magazines 32.

Within the scope of the present embodiment, use may be made of a broad range of machining tools and/or machining installations 30 such as, for example, cutting tools (drills, milling cutters, etc.), edge-banding installations, extruding installations, coating installations, laminating installations, cleaning installations, degreasing installations, installations for improving the adhesive and wetting properties of the surfaces to be imprinted, and installations for reducing the electrostatic charging of the surfaces to be imprinted. Obviously, these tools and installations can also be stand-alone means (means independent of a spindle unit).

In the present embodiment, there extends below the portals 4 a workpiece table 20 for carrying the respective workpieces 2 to be patterned, which table is movable in the x direction shown in FIG. 1. The workpiece table 20 can have a broad range of configurations and, for example, also be formed by a circulating conveyor belt or the like. On account of its movability, the workpiece table 20 forms at the same time a workpiece carrier means and a portion of the conveyor device according to the present invention.

Figure 2:
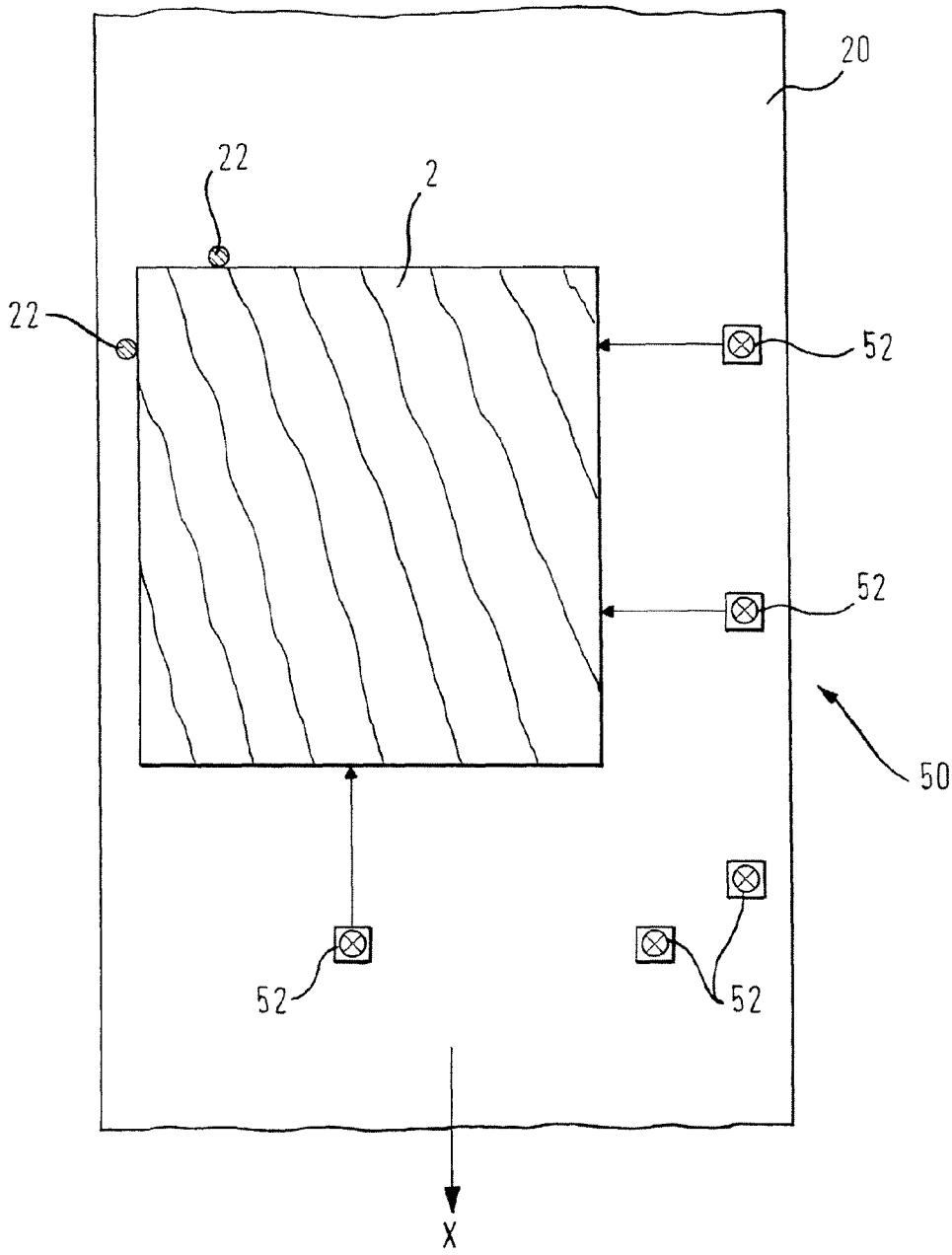
FIG. 2 is a schematic partial plan view of the device shown in FIG. 1.

FIG. 2 is a detailed plan view of the disposal of a plate-like workpiece 2 on the workpiece table 20. In the present embodiment, the workpiece table 20 has extensible stop pins 22 against which the workpiece 2 can be placed for rough positioning. Also disposed on the workpiece table 20 is a plurality of distance sensors 52 which are part of a rough detection means 50. The distance sensors shown in FIG. 2 are configured to detect the distance between the sensors and a lateral surface (narrow surface) of each workpiece 2. In the present embodiment, the sensors 52 are in this regard rotatable about an axis extending orthogonally to the surface of the workpiece table 20 and are optionally movable parallel to the surface. The rough detection means 50 is thus used for roughly detecting the geometry and positioning of each workpiece 2.

Further details of the workpiece table 20 are shown in FIG. 3 which is a partially cut-away front view of the device shown in FIG. 1. It may be seen from FIG. 3 that the respective workpiece 2 may be fixed on the workpiece table 20, for example via vacuum suction means 24. It is also possible to integrate appropriate suction means or suction openings into the workpiece table or a workpiece belt.

Figure 4:
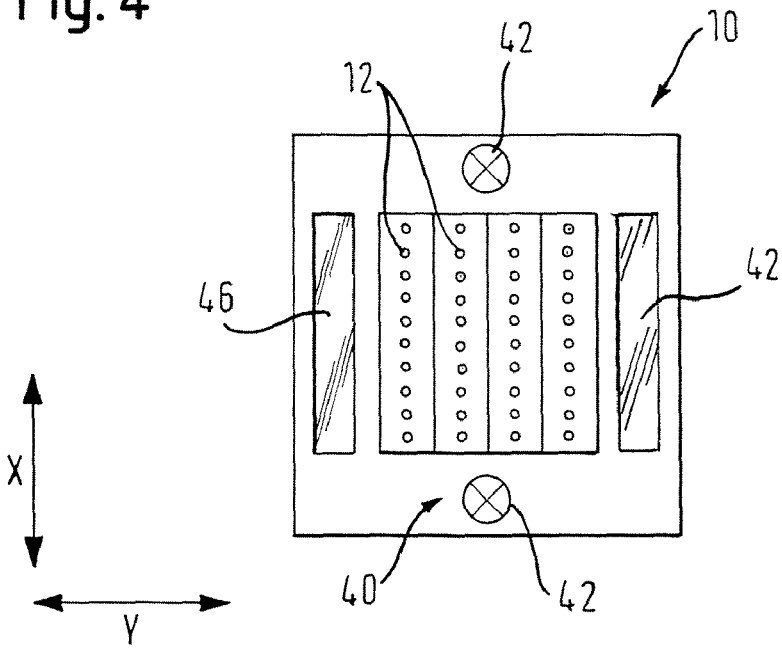
FIG. 4 shows further details of the printing means of the device shown in FIG. 1.

The device 1 according to the invention further comprises a detection means 40 for detecting the relative position of the ink-jet printing means 10 and the respective surface to be patterned of a workpiece 2. In the present embodiment, the detection means 40 has a plurality of types of sensors 42, 46 which can be seen most clearly in FIGS. 3, 4 and 5. In the present embodiment, the detection means 40 comprises first of all three distance sensors 42 which are disposed on the printing means 10 adjacently to the nozzles 12 and measure in a direction substantially parallel to the direction in which ink is expelled from the nozzles 12 (FIG. 4). On the one hand, these distance sensors can be used to determine the absolute distance between the printing means 10 and the workpiece 2; however, in addition, the precise contour of each workpiece 2 can also be inferred from the distance data obtained.

Figure 5:
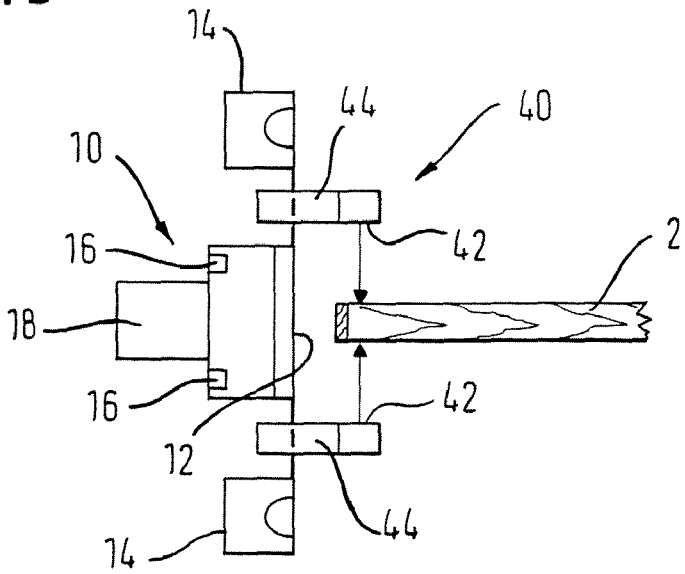
FIG. 5 shows further details of the printing means of the device shown in FIG. 1.

As may be seen most clearly in FIGS. 3 and 5, further distance sensors 42 are disposed on the printing means 10, in each case via an element 44 which, in the present embodiment, is able to pivot. The pivotable element 44 allows each sensor to be brought into an extended position which can be seen most clearly in FIG. 5. In this position, the sensors 42, shown in FIG. 5, measure in a direction substantially orthogonal to the direction in which ink is expelled from the nozzles 12. This allows the thickness or height of each region to be imprinted to be detected and an overspray to be avoided.

In addition, in the present embodiment, there are disposed on the printing means 10, adjacently to the ink expelling nozzles 12, two image detection sensors 46 which also measure in a direction substantially parallel to the direction in which ink is expelled from the nozzles 12. However, it should be noted in this regard that, alternatively or in addition to these image detection sensors, one or more image detection sensor (s) can also be—stationarily or movably—disposed at another suitable point of the device.

The image detection sensors 46 may, for example, be a CCD camera or the like which can produce a complete image of a region of the respective workpiece 2 that is to be imprinted or has already been imprinted.

Although not shown in the figures, all of the sensors, on the one hand, and the printing means and preferably also the remaining operating components of the device 1, on the other hand, are connected to a control means which evaluates the respective data collected by the sensors and on this basis controls the operation of the device, in particular of the printing means. The control means is in this case configured to analyse the image data obtained by the image detection sensors, at least with regard to the colour spectrum, defects and geometry of the imprinted or unimprinted workpiece surface.

Also provided (FIG. 3) on the printing means 10 are drying units 14, for example UV driers, which are used promptly to dry the ink applied by the printing means in order to prevent possible distortion or smudging of the printed image. Although not shown in the figures, the drying units 10 can also advantageously be positioned between the nozzles 12 and the image detection sensors 46, so ink applied to the respective workpiece 2 can be dried at least in part by the drying means 14 before image detection is performed by an image detection sensor 46.

The device according to the invention may in this regard be operated as follows. First of all, a workpiece 2 is roughly positioned on the workpiece table 20 via the stop pins 22 and fixed via the vacuum suction means 24. Subsequently, the positioning and/or contour of the workpiece 2 on the workpiece table 20 are detected by the sensors 52 and this data is forwarded to the control means.

The workpiece table 20 is then moved in the x direction, so the workpiece 2 can be machined or refined by tools, installations or printing units inserted into the spindle units 6. In this regard, the printing means is, for example, operated as follows.

Based on the data from the sensors 52, the printing means 10 is moved with the corresponding spindle 6 along the portal 4 to the workpiece 2 to be imprinted. In this regard, the sensors 42, 46 continuously perform a measuring operation, thus allowing the presence and, if appropriate, the distance of each workpiece and, in addition (by way of the leading image detection sensor 46), further information about the workpiece 2 to be obtained.

Based on this data, the control means issues print signals to the respective nozzles 12 (or the associated piezoelectric actuators or thermocouples), so the workpiece 2 is imprinted. Individual nozzles or groups of nozzles can in this regard be switched on or off as a function of the detection data of the sensors 42, 46 in order to compensate for dimensional, positional or other tolerances or deviations of the workpiece 2. Alternatively or additionally, it is also possible, within the scope of the invention, for individual nozzles or a plurality of nozzles of the printing means 10 to be produced via piezo adjustment means or the like, in order to adapt the position or direction of expulsion thereof to the workpiece 2.

When imprinting a large lateral surface of a workpiece 2, there operate, in addition to the image detection sensor 46, primarily the sensors 42 which are disposed next to the nozzles 12 and can be seen most clearly in FIG. 4. In order to imprint a narrow surface of the workpiece 2, use is alternatively or additionally made of the sensors 42 which are extensible via pivotable elements 44 in order to detect the height of the narrow surface and thus to prevent an overspray.

Once a surface portion has been imprinted, it can optionally be dried by the drying units 14, if necessary simultaneously to the printing process.

Furthermore, not only the leading image detection sensor 46 (the image detection sensor 46 located in front during the printing process in the direction of movement of the printing unit 10) but also the trailing image detection sensor carries out image detection during the printing process. This actual image data is forwarded to the control means and compared with actual image data (i.e. with the image data on which the printing process is based) with regard to the colour spectrum and possible defects of the printed image applied. If deviations are ascertained in this actual/desired data comparison, the control means can take various measures. In particular, the control means can correct the control signals (control pulses) issued to the printing means on the basis of the deviation, for example with regard to the waveform and/or amplitude of the control signals. Alternatively or additionally, the control means can cause the printing process to be interrupted at an appropriate moment and automatic or manual cleaning of the printing means to be carried out. In the event of large deviations between the desired/actual data, the printing means can also completely stop the operation of the device or issue error messages stating, for example, that the printing means requires maintenance, other printing inks have to be used, etc.

FIG. 6 illustrates schematically the paths of movement of the printing means 10 and/or the workpiece 2. The left-hand drawing in FIG. 6 shows an operation in what is known as transverse printing in which the printing means 10 moves back and forth in the y direction, together with the spindle unit 6, along the portal 4, and the workpiece table 20 further clocks the workpiece 2 in the x direction.

Alternatively, it is also possible to use the printing model which is shown on the right-hand side in FIG. 6 and is referred to as longitudinal printing. In this model, the printing means 10 is itself substantially stationary during the printing process, and the workpiece 2 is moved back and forth in the x direction with the workpiece table 20. The printing means 10 has therefore merely to be further clocked in the y direction once the printing of a web is completed. In addition, within the scope of the present invention, combinations of both operations are also possible, and webs disposed, for example, obliquely or the like can be printed.

The invention claimed is:

1. A device for patterning wood or wood-containing workpieces, comprising:

an ink-jet printer having a plurality of nozzles from which drops of ink can be expelled;

a workpiece carrier for carrying the workpiece to be patterned;

a conveyor device for bringing about a relative movement between the workpiece to be patterned and the ink-jet printer; and at least one machine tool for machining a workpiece;

at least one image detection sensor;

a control means which is connected to the at least one image detection sensor and the ink-jet printer, wherein the control means is configured to analyze image data obtained by the image detection sensor, with regard to the color spectrum and/or defects and/or geometry and/or color space.

2. A device according to claim 1, wherein at least one image detection sensor has a CCD camera or color measuring device.

3. A device according to claim 1, further comprising a drying means.

4. A device according to claim 3, wherein the drying means is disposed in such a way that ink applied to the respective workpiece can be dried at least in part by the drying means before image detection is performed by the at least one image detection sensor.

5. A method for patterning wood or wood-containing workpieces using a device according to any one of the preceding claims, the method comprising:

imprinting at least a portion of a workpiece with an ink-jet printer; and carrying out image detection in the region of the imprinted portion using an image detection sensor.

6. A method according to claim 5, wherein the actual image data obtained through the image detection is compared with desired image data with regard to the color spectrum and/or defects and/or geometry and/or color space.

7. A method according to claim 6, wherein control signals issued by a control means to the ink-jet printer are corrected on the basis of the desired/actual data comparison in order to minimize deviation between the desired/actual data.

8. A method according to claim 7, wherein the control signals issued by the control means to the ink-jet printer are corrected in such a way that the intensity and/or course of the control pulses to at least one nozzle of the printing means are altered.

9. A method according to claim 8, wherein the control signals issued by the control means to the printing means are corrected in such a way that the intensity and/or course of the control pulses to at least one nozzle of the ink-jet printer is altered.

10. A method according claim 9, wherein cleaning of the ink-jet printer is carried out on the basis of the desired/actual data comparison in the event of a predetermined deviation between the desired/actual data.

11. A method according claim 8, wherein cleaning of the ink-jet printer is carried out on the basis of the desired/actual data comparison in the event of a predetermined deviation between the desired/actual data.

12. A method according to claim 7, wherein the control signals issued by the control means to the ink-jet printer can be corrected in such a way that one or more nozzles are switched on or off.

13. A method according claim 12, wherein cleaning of the ink-jet printer is carried out on the basis of the desired/actual data comparison in the event of a predetermined deviation between the desired/actual data.

14. A method according claim 7, wherein cleaning of the ink-jet printer is carried out on the basis of the desired/actual data comparison in the event of a predetermined deviation between the desired/actual data.

15. A method according claim 6, wherein cleaning of the ink-jet printer is carried out on the basis of the desired/actual data comparison in the event of a predetermined deviation between the desired/actual data.

* * * * *